United States Patent [19]

Hanosh

[11] Patent Number: 4,679,501

[45] Date of Patent: Jul. 14, 1987

[54] REGISTRATION DEVICE FOR USE IN SILK SCREEN PRINTING

[76] Inventor: Alan L. Hanosh, 4025 Bohannon Dr., Menlo Park, Calif. 94025

[21] Appl. No.: 827,641

[22] Filed: Feb. 10, 1986

[51] Int. Cl.[4] ..... B41F 15/00; B41M 1/18

[52] U.S. Cl. ..... 101/114; 101/126; 118/713

[58] Field of Search ..... 101/129, 114, 126, 127, 101/128, DIG. 12; 118/712, 713

[56] References Cited

U.S. PATENT DOCUMENTS

| | | | |
|---|---|---|---|
| 2,943,565 | 7/1960 | Malek | 101/126 X |
| 3,728,298 | 4/1973 | Hartmann | 101/129 |
| 3,943,851 | 3/1976 | Inada et al. | 101/DIG. 12 |
| 4,005,651 | 2/1977 | Sigel et al. | 101/DIG. 12 |
| 4,073,232 | 2/1978 | Brewer | 101/126 |
| 4,226,181 | 10/1980 | Ericsson | 101/129 |
| 4,315,461 | 2/1982 | Harpold | 101/126 |
| 4,463,673 | 8/1984 | Moore | 101/126 |

FOREIGN PATENT DOCUMENTS

| | | | |
|---|---|---|---|
| 65557 | 5/1980 | Japan | 101/129 |

*Primary Examiner*—E. H. Eickholt
*Attorney, Agent, or Firm*—Edgar W. Averill, Jr.

[57] ABSTRACT

A registration device for use in silk screen printing of garments and other articles. The device facilitates the accurate positioning of the garment or other article to be printed. The device has a support arm which is held in a fixed position in respect to the platen of the silk screen printing apparatus. The support arm holds a frame which is affixable to a transparent sheet. The sheet is taped to the platen and marked with the silk screen indicia. The frame is then moved over the transparent sheet and taped to the sheet. The sheet is then detached from the platen and moved away therefrom on the frame. The garment to be marked is then placed on the platen, and the transparent sheet and frame is temporarily returned to its original position and placed over the garment to be marked. The garment is then alignd so that the spot on the garment to be marked is directly below the indicia on the transparent sheet. The frame and sheet are then moved away and the garment is accurately printed.

5 Claims, 6 Drawing Figures

REGISTRATION DEVICE FOR USE IN SILK SCREEN PRINTING

BACKGROUND OF THE INVENTION

The field of the invention is silk screen printing apparatus, and the invention relates, more particularly, to means and apparatus for positioning the garment or article to be printed in an accurate manner.

The silk screening of T-shirts and other garments has grown in popularity. It is often important that the garment be marked directly in the center of a pocket or other relatively exact location. In the past, this was done by several methods. In one method, it was accomplished by taping a piece of relatively thick cardboard in the spot where the printing is to be done and then placing the garment to be marked in the correct location by feeling the cardboard through the garment. This method was inherently inaccurate, and it often happened that the garment was mismarked and the cost of printing garments was increased whenever a garment could not be sold other than as a second. Any method for positioning garments must be capable of being used when the indicia to be printed is large, or of unusual shape or orientation. Sometimes the garment to be marked is relatively thick such as a sweat shirt and the approach of feeling a layer of cardboard under the sweat shirt was not practical. Other articles such as signs printed on cardboard, wood or other substances can also require accurate positioning.

SUMMARY OF THE INVENTION

It is, thus, an object of the present invention to provide an apparatus and a process for the accurate positioning of the marking of a silk screening apparatus on a garment or other object.

The present invention is for an apparatus and the process of using the apparatus consisting of a registration device for use in silk screen printing of garments and other materials to facilitate the accurate positioning of the garment or other article to be printed. The registration device has a support arm affixed in a fixed position in respect to the platen of a silk screen printing apparatus. A frame holding arm support block and frame holding arm assembly is affixed to the support arm. The frame holding arm has a fixed end where it is attached to the support block and a free end. The support block pivotally holds the arm in a manner which permits it to move in a generally horizontal plane. The support block has stop means to accurately position the frame holding arm in a specific home position. Frame means are adjustably affixed to the end of the frame holding arm, and the frame is movable to contact the platen of the silk screening apparatus when the frame holding arm is in its home position. A transparent sheet, having the indicia to be printed on its upper surface is affixed to the frame whereby when an object to be silk screened is placed on the platen, the transparent sheet can be placed in its home position over the garment or object and the object moved so that the indicia on the transparent sheet is directly over the desired spot for printing. Preferably, the home position is caused by the movement of a cam and cam follower combination between the fixed end of the frame holding arm and the support block. Furthermore, it is preferable that the frame be a heavy wire frame which may be adjusted to any position at the movable end of the frame holding arm.

DESCRIPTION OF THE PREFERRED EMBODIMENTS

Figure 1:
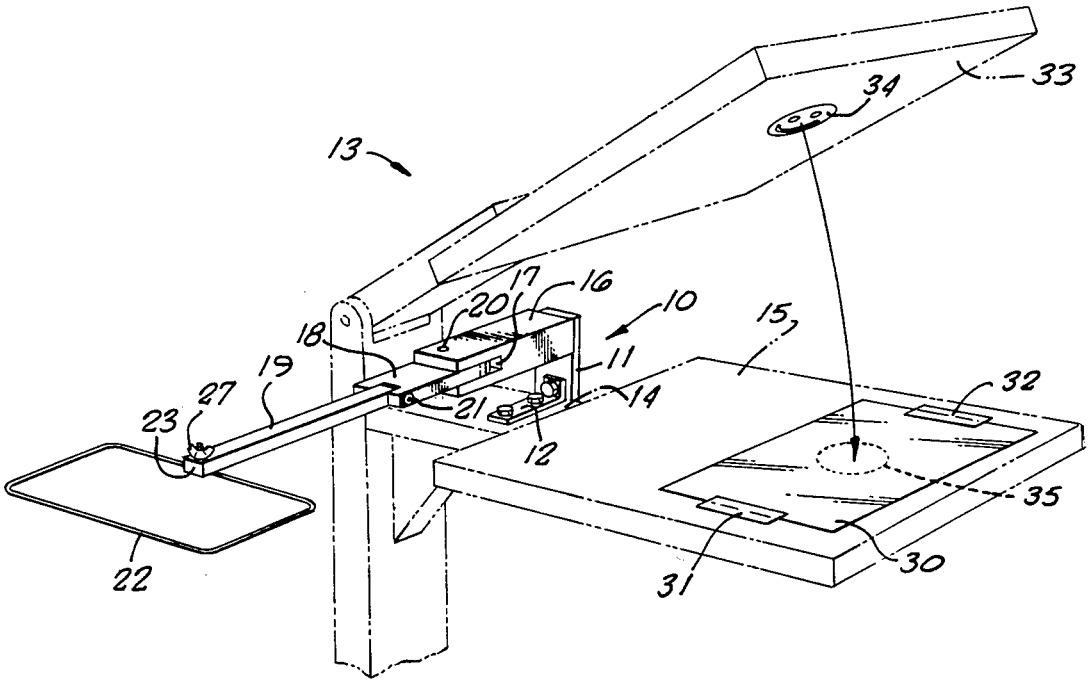
FIG. 1 is a perspective view of the registration device of the present invention affixed to a silk screen printing apparatus shown in phantom view.

The registration device of the present invention is shown in FIG. 1 and indicated generally by reference character 10. Registration device 10 has a support arm 11 which includes a bracket 12 which is attachable to a silk screen printing apparatus shown in phantom lines and indicated generally by reference character 13. The silk screen printing apparatus has a platen support shelf 14 which supports platen 15. The silk screen printing apparatus is conventional, and the registration device of the present invention may be affixed to most of the commonly used silk screen printing machines or table tops. It is important that the registration device 10 be fixable in a fixed position with respect to the platen of the silk screen printing apparatus to which it is attached so that it may accurately return to its home position and carry out the function set forth below. The term, "silk screen printing apparatus," is intended herein in a broad sense and includes table top mounted equipment.

The registration device has a frame holding arm support block 16 affixed to the support arm. Support block 16 has a slot 17 which pivotally holds a pivot block 18 which, in turn, pivotally holds a frame holding arm 19. A pin 20 holds pivot block 18 to support block 16 and a pin 21, likewise, holds frame holding arm 19 to pivot block 18.

Figure 6:
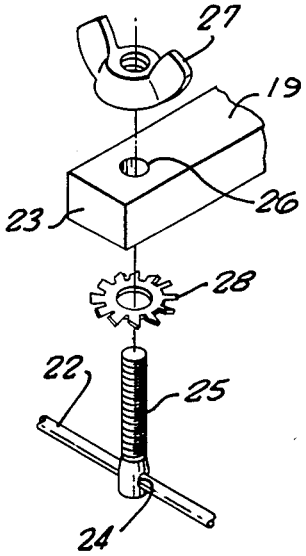
FIG. 6 is an exploded perspective view of the frame holding pin at the end of the frame holding arm of the registration device of FIG. 1.

A heavy wire frame 22 is affixed to the free end 23 of frame holding arm 19. The details of the attachment of the heavy wire frame 22 are shown in exploded, perspective view in FIG. 6 where it can be seen that frame 22 passes through an opening 24 in threaded pin 25. Threaded pin 25 passes through a hole 26 at the free end 23 of arm 19. Wing nut 27 threads onto the end of threaded pin 25 and pulls it tightly against toothed lock washer 28 thereby holding frame 22 in the desired position. Returning to FIG. 1, it can be seen that by loosening wing nut 27 that the frame may move back and forth at the end of arm 19 and, in fact, the threaded pin 25 may be moved along any of the four sides of the rectangular frame 22. Furthermore, frame 22 may be pivoted downwardly from its position, as shown in FIG. 1, a full one hundred eighty degrees so that it may be moved to the close side of platen 15 and, thus, by the adjustment of frame 22, it may cover any part of platen 15 and permit printing to be accurately made over essentially the entire upper surface of platen 15.

Figure 2:
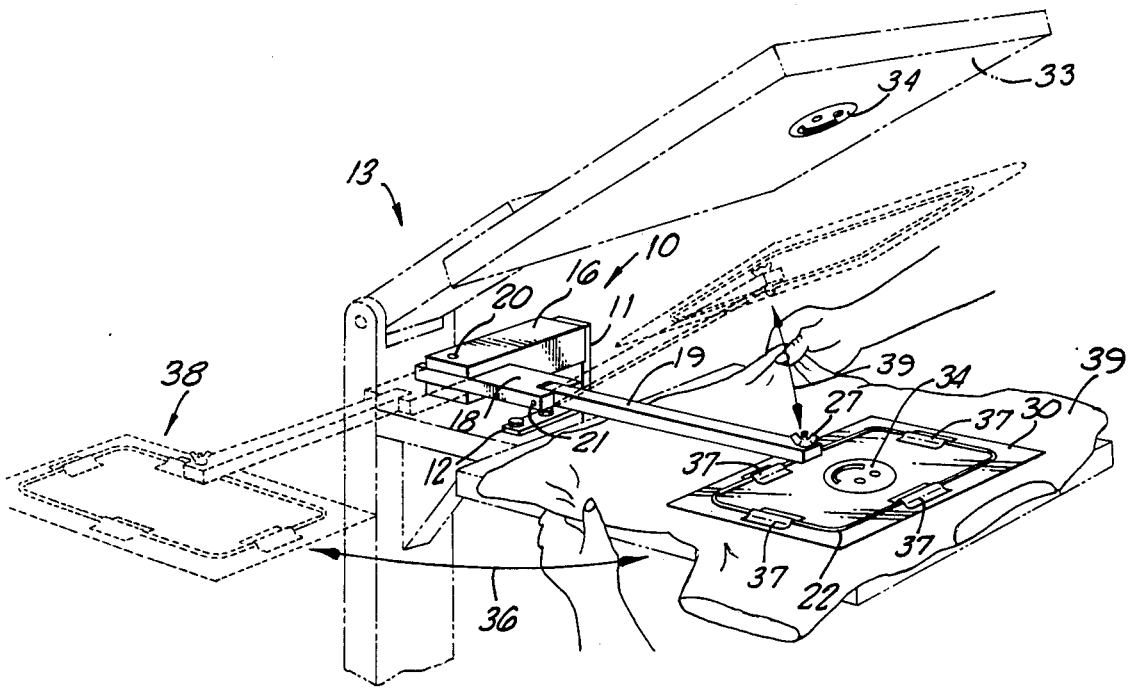
FIG. 2 is a perspective view of the registration device and silk screen printing apparatus of FIG. 1 showing the registration device in its home position.

The device of the present invention is used by first taping a transparent sheet 30 to the upper surface of platen 15. Readily removed tape, such as masking tape, 31 and 32 is preferable since sheet 30 will soon be released from the surface of platen 15. Next, indicia indicated on the under surface of silk screen 33 by reference character 34 will be marked in the position shown by the dotted line identified by reference character 35 on the upper surface of transparent sheet 30. As described in further detail below, pivot block 18 is readily movable to a preset "home" position where the frame is over the platen as shown in FIG. 2. After the indicia 34 has been printed, the heavy wire frame is moved into its "home" position from its remote position indicated in phantom lines and by reference character 38 in FIG. 2. The movement from its remote position is indicated by the arrow 36 in FIG. 2. The frame is then securely taped in its "home" position to the transparent sheet 30, and the two lengths of masking tape 31 and 32 are removed and discarded. The frame is taped by four lengths of masking tape indicated by reference character 37 in FIG. 2. After transparent sheet 30 has been securely taped to heavy wire frame 22, it is moved to the remote position indicated by reference character 38 in FIG. 2 and a garment 39, such as a T-shirt, is placed on the upper surface of platen 15. The frame and transparent sheet are next moved back to their home position. Since the registration device is capable of accurately returning arm 19 and frame 22 to the same position repeatedly, which is referred to as the "home position," it is apparent that indicia 34 will always be printed at the same spot that it temporarily is placeable by moving the transparent sheet to its home position. Thus, garment 39 may be moved freely under transparent sheet 30 until indicia 34 is in the exact desired position. The frame 22 and arm 19 are then moved upwardly as indicated by arrow 39 and outwardly back to the remote position shown by reference character 38 where it is free and away from any interference with the silk screen 33. Silk screen 33 is then moved downwardly and the indicia printed by a squeegee or roller in the usual manner. However, unlike the usual manner, the indicia is accurately placed at the exact desired location.

Figure 3:
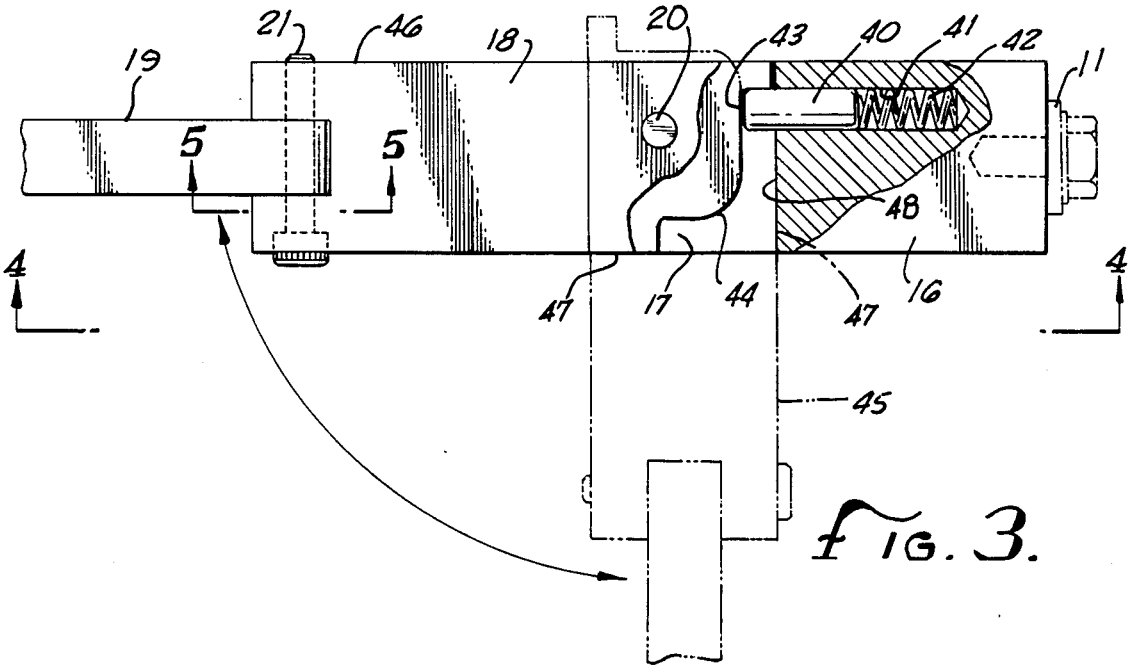
FIG. 3 is an enlarged plan view of the frame holding arm support block of the registration device of FIG. 1.
Figure 4:
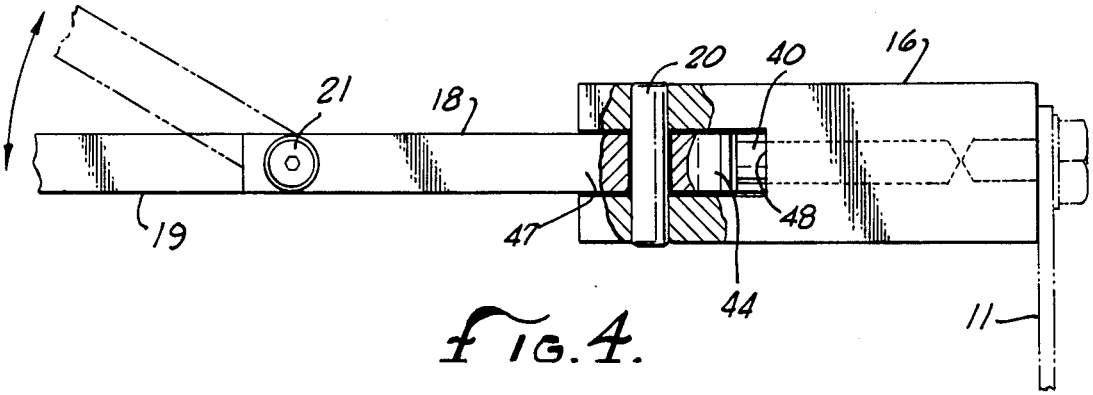
FIG. 4 is a side view taken along line 4—4 of FIG. 3.

The manner in which the home position is found is shown in FIG. 3 where it can be seen that support block 16 supports a cam follower 40 which is placed in an opening 41 which holds biasing means such as helical spring 42. The end 43 of cam follower 40 contacts cam surface 44. The home position of the registration device is shown in phantom lines in FIG. 3 and indicated by reference character 45 where side 47 of pivot block 18 contacts face 48 of slot 17. This contact provides stop means to hold the frame holding arm 19 in its home position 45. The position at which the transparent sheet is free from any interference with the silk screen printing apparatus is indicated by reference character 46.

Figure 5:
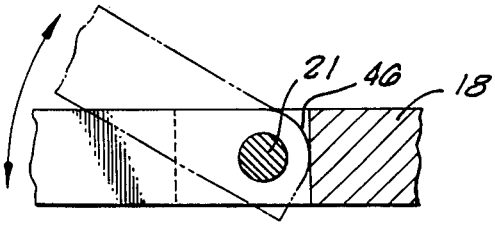
FIG. 5 is a cross-sectional view taken along line 5—5 of FIG. 3.

It is also beneficial that the frame holding arm 19 be capable of pivoting upwardly so that it may readily be moved away from any interference with the garment to be printed. This is readily accomplished by the affixing of arm 19 to block 18 by a pin 21 and by rounding off the fixed end of arm 19 as indicated by reference character 46 in FIG. 5.

The registration device of the present invention can be used to add words, letters or color after a design print is cured. Furthermore, because of its transparent sheet, it is readily possible to print between the lines of a garment to produce a superior printed product than heretofore practical. The positioning of the garment is fast, and the use of the device of the present invention requires very little training.

While the apparatus of the present invention uses a cam and cam follower positioning method, other positioning methods, such as a spring with a catch to hold the arm out of the way, may alternatively be used. While the term, "silk screening," has been used herein, other screen media other than silk may, of course, be used.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A registration device for use in silk screen printing of articles to facilitate the accurate positioning of the article to be printed, said registration device comprising:

a silk screen printing apparatus supported by a printer frame and including a platen supported by said printer frame;

a support arm affixed to said printer frame in a fixed position with respect to the platen of said silk screen printing apparatus;

a frame holding arm support block and frame holding arm assembly including a frame holding arm, said assembly being affixed to said support arm, said frame holding arm having a first end where it is attached to said frame holding arm support block and a second end, said support block horizontally, pivotally holding a frame holding arm in a manner to permit said frame holding arm to move in a generally horizontal plane, said frame holding arm having two sections pivoted together so that the frame means may move upwardly, said support block having stop means to position said frame holding arm in a specific home position;

frame means affixed to the free end of said frame holding arm, the frame means being movable to contact the platen of the silk screening apparatus when said frame holding arm is in its home position; and a transparent sheet having the indicia to be printed on its upper surface affixed to said frame means whereby an object to be silk screened may be placed on said platen and moved so that the exact location to be printed may be moved under the indicia on the transparent sheet on the frame, and the frame and transparent sheet may then by swung out of the way and the object printed in the desired location.

2. The registration device of claim 1 wherein said frame means is a rectangular heavy wire frame.

3. The registration device of claim 2 wherein said heavy wire frame is held at the end of the frame holding arm by holding means including clamp means held by said frame holding arm, said clamp means being tightenable against said heavy wire frame.

4. The registration device of claim 3 wherein said clamp means comprises a rod with a hole therein and the heavy wire frame is held in said hole and said rod is held by the frame holding arm at the second end thereof so that the heavy wire frame is tightenable against said frame holding arm.

5. The registration device of claim 1 wherein said frame holding arm support block includes a cam follower and the frame holding arm includes a cam surface formed at the first end thereof contacted by the cam follower.

* * * * *